United States Patent [19]

Brennan

[11] 4,191,241

[45] Mar. 4, 1980

[54] ENERGY EXCHANGE WHEEL AND METHOD OF FABRICATION

[75] Inventor: Timothy E. Brennan, Atlantic Highlands, N.J.

[73] Assignee: Wing Industries, Inc., Cranford, N.J.

[21] Appl. No.: 971,191

[22] Filed: Dec. 20, 1978

[51] Int. Cl.[2] ..... F28D 19/00

[52] U.S. Cl. ..... 165/10; 29/157.3 R

[58] Field of Search ..... 165/8, 9, 10; 29/157.3 R

[56] References Cited

U.S. PATENT DOCUMENTS

| | | | |
|---|---|---|---|
| 3,702,156 | 11/1972 | Rohrs et al. | 165/10 |
| 4,093,435 | 6/1978 | Marron et al. | 165/10 X |

*Primary Examiner*—Albert W. Davis, Jr.
*Attorney, Agent, or Firm*—Brooks, Haidt, Haffner & Delahunty

[57] ABSTRACT

An energy exchange wheel having a wrapping hub which surrounds, and is concentric with but spaced from a central hub; an axially perforate matrix of energy exchange material around the wrapping hub; and a rim around the matrix. The axial dimensions of the central hub and the matrix correspond to the wheel depth, the axial dimension of the wrapping hub is between one-quarter and one-half of the wheel depth, and the axial dimension of the rim is at least equal to the axial dimension of the wrapping hub but less than the wheel depth. Tilted bar-like spokes secured to the central and wrapping hubs and to the rim prevent axial movement of the matrix. Also, a method for fabricating such wheel which includes wrapping the matrix material around the wrapping hub and a second, temporary wrapping hub, removal of the second hub, cutting of tilted slots in the matrix, surrounding the slotted matrix with a rim, inserting the spokes in the tilted slots, and securing the spokes to the central hub, the retained wrapping hub and the rim.

18 Claims, 9 Drawing Figures

Fig. 1.
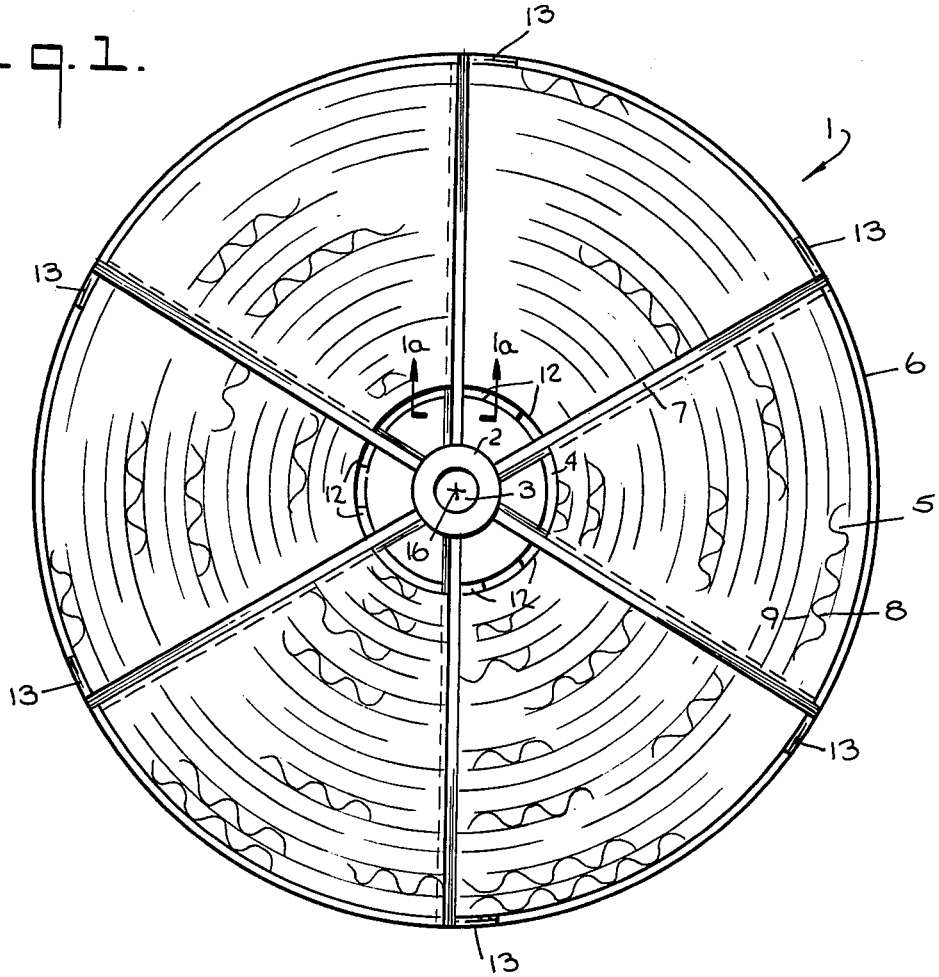
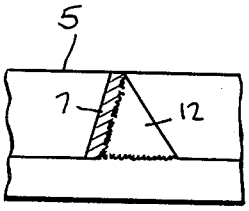
Fig. 1a.
Fig. 8.
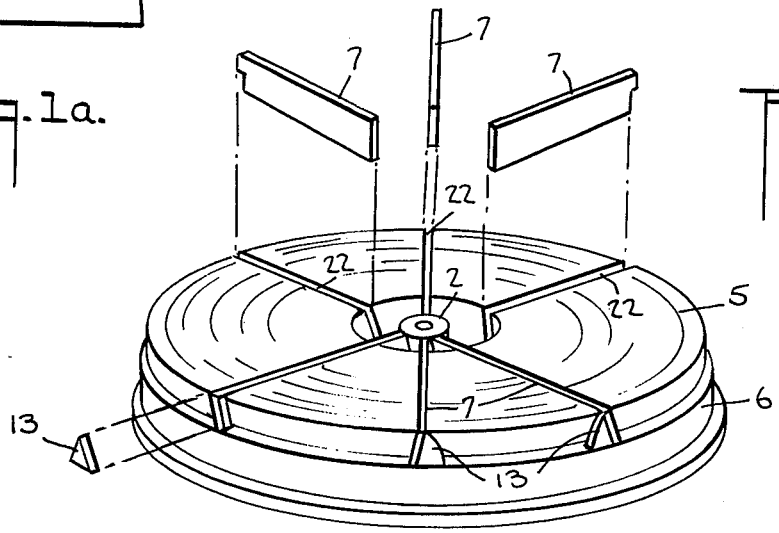

ENERGY EXCHANGE WHEEL AND METHOD OF FABRICATION

The present invention relates to an energy exchange wheel and to a method of fabricating such wheel.

Energy exchange wheels are well known in the art. See, for example, U.S. Pat. Nos. 3,702,156 and 4,093,435. Generally speaking, such wheels comprise a central hub surrounded by corrugated sheet material, metal or non-metallic or both, extending circumferentially around the hub to form a matrix through which air can pass in the direction axially of the wheel. The matrix is surrounded by a metal rim, and the rim is supported from the hub by radially extending spokes which also serve to retain the matrix in place. Usually, the spokes are disposed so that they do not extend beyond the axially opposite sides of the rm, and the spokes may be rods, bars or plates received in slots or holes in the rim of the matrix.

In the method of manufacturing an air-to-air energy exchange wheel described in U.S. Pat. Nos. 3,702,156 and 4,093,435, the corrugated and flat sheet matrix material is wound around the hub, with or without intermediate bands, until the desired diameter is reached, and then a rim is applied. Thereafter, slots lying in planes parallel to the wheel axis are cut radially in one side of the hub, the matrix material, the intermediate bands, if any, and the rim, to receive bar-like spokes. Such slots usually are cut with the wheel lying flat, i.e., with the wheel axis vertical, and after the spokes are inserted and secured, the wheel is inverted and further slots are cut and spokes are similarly installed at the axially opposite side of the wheel.

The matrix material is relatively soft and the slots may be cut therein relatively easily. However, the hub, intermediate bands and the rim are made of a relatively hard material, such as steel, which may be cut only relatively slowly. Also, the tool used for cutting, such as an abrasive wheel, is relatively expensive and wears only a small amount when cutting the matrix material. On the other hand, the tool wears relatively rapidly when cutting the hub, intermediate bands and the rim.

Furthermore, after the spokes are installed at one side, the matrix material is held within the wheel by the spokes at only one side, and during the handling of the wheel for the purpose of cutting additional slots and adding the spokes at the opposite side, e.g. inverting of the wheel, there is a problem involved in maintaining the matrix material within the wheel and in preventing displacement of the turns of the matrix material with respect to each other and to other parts of the wheel.

One object of the invention is to provide a method for manufacturing an air-to-air energy exchange wheel which avoids the problems described hereinbefore and which permits faster and more economical manufacture of such a wheel.

Another object of the invention is to provide an air-to-air energy exchange wheel which has fewer parts and which is simpler and more economical to manufacture and yet, has performance characteristics substantially the same as the prior art wheels.

In the preferred embodiment of the wheel of the invention, an inner wheel hub for receiving the mounting shaft and which extends for the axial depth of the wheel is surrounded by a wrapping hub in the form of a circular band which has an inner diameter greater than the outer diameter of the inner hub and which has an axial length less than one-half the axial depth of the wheel. One axial end of the wrapping hub is in the same radial plane as, or is flush with, an axial end of the inner hub. The matrix material of metal or non-metallic material or both, and in corrugated strip or ribbon form interleaved with flat strips or ribbons and having a width substantially equal to the axial depth of the wheel is wrapped spirally around the wrapping hub, without intermediate bands, to an outer diameter equal to the desired wheel diameter less the radial thickness of the wheel rim which closely surrounds and engages the wound matrix material. The rim is a circular band which has an axial length which is at least equal to one-half of the wheel depth but which is less than the full depth of the wheel and has one axial end in the same radial plane as, or is flush with, the axial end of the wrapping hub which is flush with an axial end of the inner hub. Preferably, the inner and wrapping hubs and the rim are made of a strong and hard metal, such as steel.

In the preferred embodiment, bar-like spokes, each having a width greater than its thickness, are installed in radial slots cut into only the wound matrix material and on only one axial side thereof. The slots are cut so that they lie in radially extending planes which are not parallel to the axis of the wheel. That is, each plane has a small pitch angle (hereinafter defined), e.g. about 3° to 5°, with respect to the wheel axis. The pitch angle may be larger, but it is kept small so that the spokes inserted in the slots will cause little obstruction to the axial air flow through the wheel. Pairs of adjacent slots have opposite pitch angles so that the spokes act in dove-tail fashion to prevent movement of the matrix material axially away from the spokes both when the wheel is lifted from its flat position during manufacture, and during operation, when it is installed in an air stream. Preferably, for reasons hereinafter explained, the number of spokes or slots divided by two is an odd, rather than an even, whole number but with other manufacturing techniques the number may be different. Preferably, also, the depth of the slots measured parallel to the wheel axis is greater than one-half but less than the full depth of the wheel, and the width dimension of the spokes is the same. The axial depth of the slots, and hence, the axial width of the spokes, is selected so as to be about equal to the wheel depth minus the axial length of the wrapping hub. The slots also extend into the wound matrix material from the axial face thereof which is opposite from that face thereof which is flush with both the axial end of the wrapping hub and the axial end of the inner hub as well as with the rim.

In the preferred embodiment, the radially inner ends of the spokes are secured to the inner hub by welding, and they are secured to the wrapping hub, where they meet the latter, by gussets welded to the spokes and the wrapping hub. At their radially outer ends, the spokes overlie an axial side of the rim and are secured to the rim by gussets welded to the ends of the spokes and to the rim.

In the preferred embodiment of the fabricating or manufacturing method of the invention, a first wrapping hub, which will be the final wrapping hub of the wheel and which has an axial length about one-third the wheel depth, is mounted on a turntable having a horizontal surface and a vertical axis of rotation, the wrapping hub being placed on such surface with its axis co-axial with the turntable axis. A second, temporary wrapping hub having an axial length equal to the wheel depth minus the axial length of the first hub is mounted on top of and co-axial with the first hub. The turntable is then rotated slowly while matrix material in strip or ribbon form is fed to and wrapped around the two wrapping hubs until the desired outside diameter of the matrix material is obtained. The end of the strip is then secured to the next adjacent inner layer of strip by tape, and the second wrapping hub is removed. Thereafter, diametrically extending slots having an axial depth equal to the axial length of the second wrapping hub are then cut into the matrix material along equally spaced diameter lines with an abrasive wheel disposed with its plane of rotation parallel to the desired diameter line and tilted at a small angle, e.g. 3°, to the perpendicular to the plane of the upper end surface of the wound matrix material. The slots are cut into the wound matrix material from the peripheral surface of the material at one side of the wheel axis to the peripheral surface at the other side of the wheel axis, and successive slots are cut with the abrasive wheel tilted at opposite sides with respect to the perpendicular to the plane of said upper end surface. In other words, one slot is cut so that its pitch angle is 3° one way and the next slot is cut so that it has an opposite pitch angle of 3°. Alternatively, all slots having the same pitch angle may be cut first and then, all slots having the opposite pitch angle may be cut.

After the slots are cut, the outer band or rim is placed around the wound matrix material by wrapping a strip of metal having a width about two-thirds of the wheel depth around the wound and slotted matrix material with one edge of the band abutting the turntable surface and then, welding the ends of the strip together. The inner hub which receives the wheel supporting shaft is then mounted on the turntable surface with its axis co-axial with the axis of the remaining, first wrapping hub.

Spokes which will fill the slots and which extend from the outer periphery of the inner hub to the outer periphery of the rim are then placed in the slots and are welded to the inner hub, the remaining wrapping hub and to the rim, the welding to the rim being performed by welding suitably shaped gussets to the spokes and to the rim. Excess weld metal on the peripheral surface of the rim and excess spoke metal at such surface of the rim is ground off. Of course, during the welding of the spokes to the rim, the rim is shaped to make its outer surface as nearly concentric with the axis of the wheel as possible within practical limits.

Other objects and advantages of the present invention will be apparent to those skilled in the art from the following detailed description of presently preferred embodiments, which description should be considered in conjunction with the accompanying drawings in which:

FIGS. 1 and 2 are, respectively, an end elevation view an an enlarged side view of a preferred embodiment of the energy exchange wheel of the invention;

FIG. 1*a* is a fragmentary, sectional view of a portion of the embodiment shown in FIG. 1 and is taken along the line 1*a*—1*a* shown in FIG. 1.

FIG. 8 is similar to FIGS. 5 and 6 and illustrates the insertion of bar-like spokes in the matrix slots.

Figure 2:
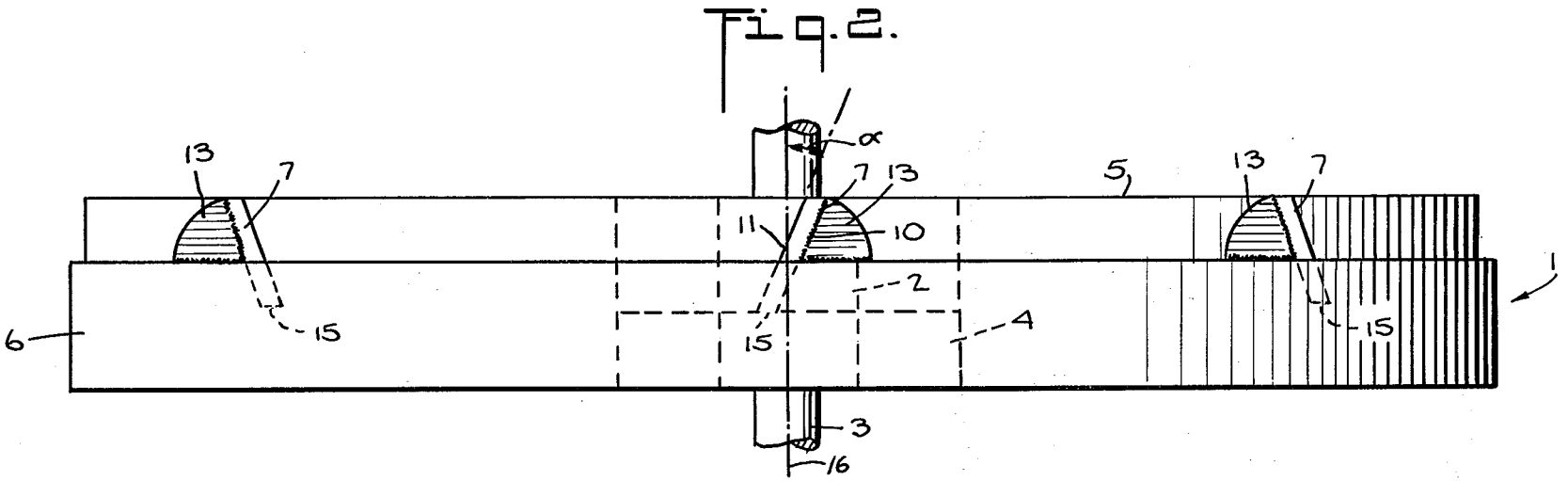

With reference to FIGS. 1 and 2, the preferred embodiment of the energy exchange wheel 1 of the invention comprises a central hub 2 through which a supporting shaft 3 passes, a wrapping hub 4, a matrix 5 having axially extending passageways, an external rim 6 and a plurality of bar-like spokes 7. Preferably, the hub 2, the shaft 3, the hub 4, the rim 6 and the spokes 7, are made of a metal, such as steel, and the material of the matrix 5 may be any of several materials, such as aluminum, stainless steel, treated paper, asbestos or a combination thereof. Usually, the material of the matrix will be in strip form, the width of the strip being equal to the depth of the wheel 1, i.e. its dimension in the axial direction, and the matrix 5 will comprise a corrugated strip 8 adjacent a flat strip 9 which prevents inter-locking of the corrugations. However, the matrix 5 may take other forms which provide axially extending passageways through the matrix 5, and the invention relates mainly to the supporting and containing structure for the matrix 5 even though a matrix 5 of wrapped strip material is preferred.

Figure 3:
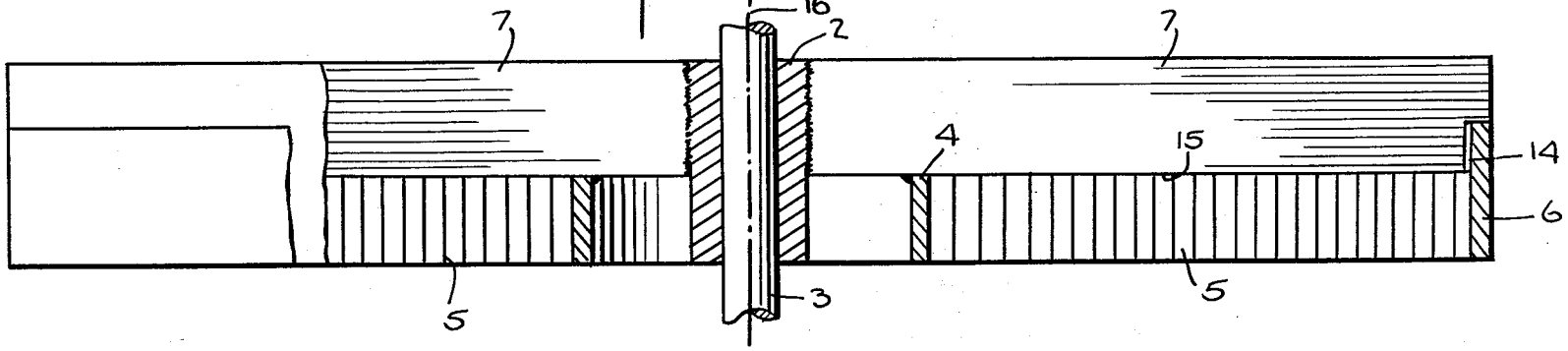
FIG. 3 is similar to FIG. 2 but is partly in cross-section.

The bar-like spokes 7 are received in slots cut into the matrix 5, and preferably, for ease in construction, the spokes 7 are not secured to the material of the matrix 5. However, if desired, the inwardly facing face 10 and the outwardly facing face 11 may have adhesive thereon to secure the matrix material to the spokes 7. Preferably, the slots in the matrix 5 are filled by the spokes 7 and both of the faces 10 and 11, which have a width which is several times the thickness of the spokes 7, contact the sidewalls of such slots. As shown in FIG. 3, each spoke 7 extends from the central hub 2, to which the inner end of the spoke 7 is welded, to the peripheral surface of the rim 6. Each spoke 7 is also secured to the wrapping hub 4 by means of a gusset 12 (FIGS. 1 and 1*a*) welded to the spokes 7 and the hub 4, and is secured at its outer end to the rim 6 by means of a gusset 13 welded to both the spoke 7 and the rim 6 (see FIG. 2). At its outer end, each spoke 7 has a portion cut away so as to leave a space 14 between the spoke 7 and the rim 6 for adjustment purposes. The side edge face 15 of each spoke 7 engages the material of the matrix 5.

An important feature of the invention is the disposition of the spokes 7 so that they restrain the matrix 5 against axial movement, radial movement of the matrix 5 being restrained by the hub 4 and the rim 6. From FIG. 2, it will be observed that the bar-like spokes 7 are tilted with respect to the axis 16 of the wheel 1, that is, the plane of the outwardly facing face 11 of the spokes 7 intersects, at a small angle $\alpha$, a plane which contains the axis 16 and which is perpendicular to a plane which is also perpendicular to the plane of the face 11. For simplicity, the angle $\alpha$ will be identified as the pitch angle, the common designation of such angle. It will be noted that when the pitch angle $\alpha$ is zero, the spokes 7 provide the least obstruction to axial flow of fluid through the wheel 1 whereas, as the pitch angle $\alpha$ increases, the flow obstruction caused by the spokes 7 increases. However, when the angle $\alpha$ is zero, the matrix 5 can readily move downwardly, as viewed in FIG. 2, even through the spokes 7 will prevent movement of the matrix 5 upwardly with respect to the hubs 2, and 4 and the rim 6. On the other hand, it has been found that with a small pitch angle $\alpha$, i.e. of about 2° or more and preferably, at least 3° to 5°, the matrix 5 cannot move downwardly, as viewed in FIG. 2 by any significant amount provided that the axial depth of the slots is at least 3 inches. The angle $\alpha$ is kept as small as possible, consistent with retention of the matrix 5 and preferably, does not exceed 10°. Of course, it should be borne in mind that the depth of the wheel 1 usually is at least eight inches and that the axis 16 usually is horizontal rather than vertical as shown in FIGS. 2 and 3.

Although, in the preferred embodiment, the hubs 2 and 4, the rim 6 and the spokes 7 are made of metal and the hubs 2 and 4 and the rim 6 are secured to the spokes 7 by welding, such construction is preferred for rigidity purposes, the wheel 1 usually being several feet in diameter. However, if desired or practical, other materials may be used for the hubs 2 and 4, the rim 6 and the spokes 7 and other devices, such as adhesives, fasteners, etc. may be used to secure them together particularly if the wheel 1 is of relatively small diameter.

In the wheel of the invention, it is preferred that the axial dimensions of the matrix 5 and the hub 2 be equal to the wheel depth, that the axial dimension of the hub 4 be at least one-quarter of, but no greater than one-half of, the wheel depth, that the axial dimension of the rim 6 be at least equal to the axial dimension of the hub 4 but less than the wheel depth. Also, the axial dimension of the spokes 7, at least adjacent the hubs 2 and 4, is substantially equal to the wheel depth minus the axial dimension of the hub 4. The spokes 7 may have the same axial dimension substantially throughout their lengths, but their dimensions may vary throughout their lengths. For example, the spokes 7 may taper in axial dimension from greatest adjacent the hubs 2 and 4 to smallest, e.g. equal to the wheel depth minus the axial dimension of the rim 6, at their readially outer ends. The spacing between the inner surface of the hub 4 and the outer surface of the hub 2 should be sufficient to permit securing of the spokes 7 to the hubs 2 and 4 and preferably, should be about six inches. Most preferred axial dimensions are as follows:

| PART | RELATION |
|---|---|
| Matrix 5 | wheel depth |
| Hub 2 | wheel depth |
| Hub 4 | about $\frac{1}{4}$ of wheel depth |
| Rim 6 | about $\frac{1}{2}$ of wheel depth |
| Spokes 7 | wheel depth minus axial dimension of hub 4 |

Although other relative positions are possible, it is preferred that one axial end of each of the hubs 2 and 4 and the rim 6 be flush with an axial end surface of the matrix 5, and that the exposed side edges of the spokes 7 be flush with the opposite axial end surface of the matrix 5, such construction simplifying the use of seals which are conventionally used with energy exchange wheels to separate oppositely flowing fluid which passes through the wheel 1.

Figure 4:
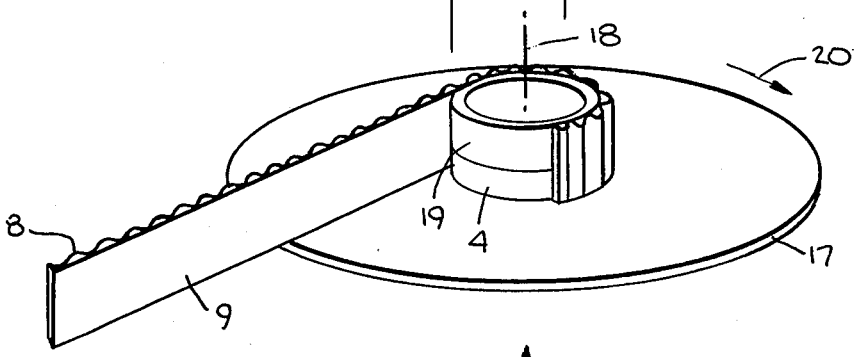
FIG. 4 is a perspective view illustrating the commencement of the winding of a strip of matrix material in accordance with the preferred method of fabricating the wheel illustrated in FIGS. 1–3.

The preferred method of manufacturing the preferred embodiment of the wheel 1 hereinbefore described will be described in connection with FIGS. 4–8. FIG. 4 illustrates the mounting of the wrapping hub 4 on, and co-axial with, a turntable 17 having a horizontal surface and rotatable about a vertical axis 18. A second temporary wrapping hub 19 is mounted on and co-axial with the hub 4, and the hubs 4 and 19 may be secured to the turntable 17 in any desired manner. The turntable 17 is rotatable in the direction of the arrow 20 by any conventional means, and as the turntable 17, and hence, the hubs 4 and 19, are rotated, the material of the matrix 5, comprising the corrugated strip 8 and the flat strip 9, is fed onto the outer surfaces of the hubs 4 and 19.

Figure 5:
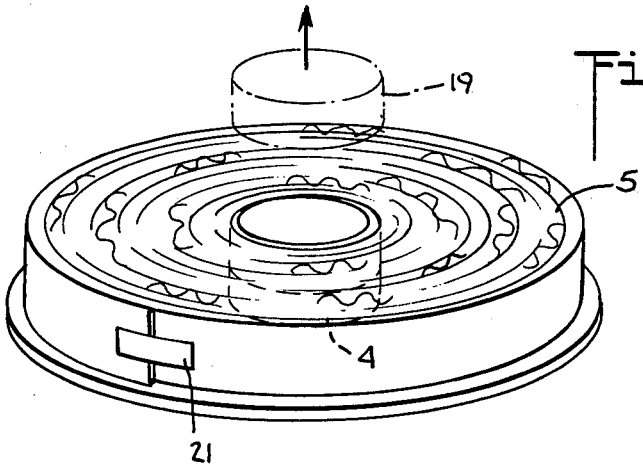
FIG. 5 is a perspective view of the partially completed wheel after the matrix material has been wound on the wrapping hubs.
Figure 6:
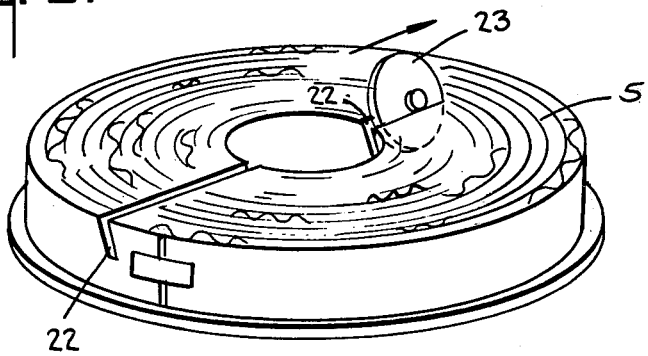
FIG. 6 is similar to FIG. 5 and illustrates the cutting of slots in the wound matrix material.

When the diameter of the matrix material reaches the desired diameter, such as the diameter indicated in FIG. 5, the free end of the matrix material 8, 9 is secured to the underlying material, such as by a tape 21. Thereafter, the temporary wrapping hub 19 is removed, and as indicated in FIG. 6, slots 22 for receiving the spokes 7 are cut into the matrix from the upper end surface of the matrix 5, by means of a grinding wheel 23 rotated and fed in any conventional manner. It will be observed that the grinding wheel is tilted so as to provide walls of the slots 22 at the pitch angle $\alpha$.

In the preferred method, the grinding wheel 23 first engages the matrix 5 at a first point on its peripheral surface and is then fed across the matrix 5 along a diameter line until it reaches an opposite point on its peripheral surface. When slots 22 are cut in this manner diametrically opposite spokes 7 will be tilted in the same direction and upon analysis, it will be found that if the spokes 7 are to be equally spaced circumferentially and adjacent pairs of spokes 7 are to be oppositely tilted, the number of spokes 7 divided by two must be equal to an odd whole number. However, if each slot 22 is cut at the appropriate angle from the periphery of the matrix 5 only up to the axis 16, then, the number of spokes 7 may be any even number, preferably at least four.

Figure 7:
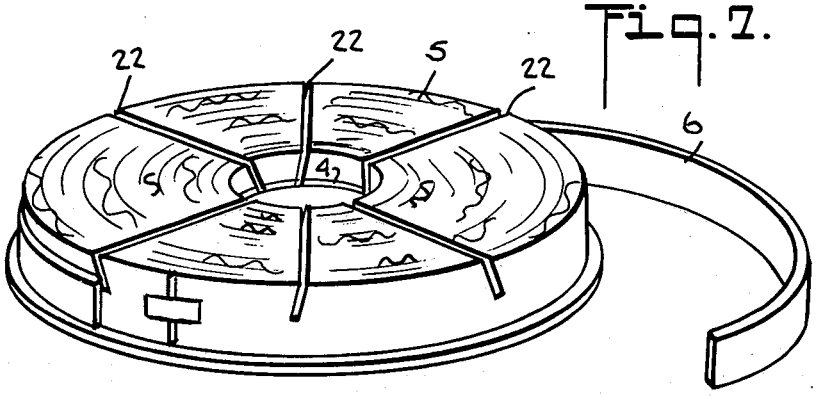
FIG. 7 is similar to FIGS. 5 and 6 and illustrates the enclosing of the matrix by a rim.

The appearance of the matrix 5 after the slots 22 have been cut is illustrated in FIG. 7, and after the slots 22 have been cut, a metal strip, which is to form the rim 6, is wrapped around the matrix 5 and the ends thereof are welded together to form the rim 6.

Thereafter, the spokes 7 are inserted in the slots 22 as indicated in FIG. 8, and the spokes 7 are welded to the hub 2, the hub 4 and the rim 6. During the welding of the spokes 7 to the various parts, the position of the hub 2, the hub 4 and the rim 6 are adjusted as required to maintain such parts concentric with each other and the axis 16 of the wheel 1.

If required, after the welding is performed, the outer ends of the spokes 7, the weld material connecting the gusset 13 to the spokes 7, and the periphery of the rim 6 are ground to remove irregularities, bearing in mind, that it is customary to rotate the wheel 1 by means of a belt engaging the periphery of the rim 6.

Although preferred embodiments of the present invention have been described and illustrated, it will be understood by those skilled in the art that various modifications may be made without departing from the principles of the invention.

What is claimed is:

1. An energy exchange wheel having a central axis and comprising:

an inner hub concentric with said axis;

an outer rim concentric with said axis and having its inner periphery spaced from the outer periphery of said hub;

an axially perforate matrix of energy absorbing material filling the space between said rim and said hub, said matrix having a plurality of slots therein extending radially from said hub to said rim;

a plurality of bar-like spokes equal in number to the number of said slots disposed in said slots and extending at least from said hub to said rim, said spokes being secured to said rim at their radially outer ends and each spoke having a face in contact with a wall of the slot in which it is disposed, said face and said wall having a pitch angle with respect to said axis which will prevent movement of said matrix in a direction axially and away from said spokes; and means maintaining the radially inner ends of said spokes in fixed relation to said hub.

2. A wheel as set forth in claim 1 wherein the faces of pairs of adjacent spokes have opposite pitch angles and the angles are in the range of from 2° to 10°.

3. A wheel as set forth in claim 1 or 2 wherein said hub has an axial length less than the axial length of said matrix and said rim has an axial length greater than the axial length of said hub but less than the axial length of said matrix.

4. A wheel as set forth in claim 3 further comprising a central hub concentric with said axis and within said inner hub, said central hub having its outer periphery spaced from the inner periphery of said inner hub, wherein said spokes extend from said central hub to said rim and wherein said means maintaining said inner ends of said spokes in fixed relation to said hub comprises means securing said spokes to said central hub and said inner hub.

5. A wheel as set forth in claim 4 wherein said slots and said spokes have an axial dimension, at least at their portions adjacent said inner hub, substantially equal to the axial length of said matrix minus the axial length of said inner hub.

6. A wheel as set forth in claim 4 wherein said inner hub has an axial length at least equal to one-quarter of, but no greater than one-half of, the axial length of said matrix.

7. A wheel as set forth in claim 4 wherein the axial length of said rim is at least equal to one-half of the axial length of said matrix and said spokes are secured to said rim by gussets welded to said spokes and to said rim.

8. A wheel as set forth in claim 4 wherein the corresponding axial ends of said inner hub, said central hub and said rim are flush with an axial end surface of said matrix.

9. A wheel as set forth in claim 8 wherein the number of spokes divided by two is equal to an odd whole number.

10. A wheel as set forth in claim 4 wherein said matrix comprises alternate layers of corrugated and flat strips wound around said inner hub.

11. A method of fabricating an energy exchange wheel having at least an inner hub, an outer rim around but spaced from the inner hub, a matrix of energy absorbing material between said inner hub and said rim, said matrix having a predetermined axial length, said method comprising:

mounting a said inner hub having an axial length less than the axial length of said matrix co-axially with a wrapping hub having the same diameter as said inner hub and having an axial length substantially equal to the matrix length minus the axial length of the inner hub;

wrapping matrix material in strip form and having a width greater than the axial length of said inner hub around said inner and wrapping hubs until the diameter thereof has the desired diameter and securing the strip end in place;

removing said wrapping hub from within the wrapped matrix material;

cutting a plurality of circumferentially spaced slots in the wrapped matrix material in the axial end face thereof remote from said inner hub, said slots extending radially from the axis of said inner hub and having a depth, at least adjacent said inner hub, substantially equal to the axial length of said matrix minus the axial length of said inner hub and said slots having a significant pitch angle with respect to the axis of said inner hub with pairs of adjacent slots having opposite pitch;

enclosing the wrapped matrix material with a said rim having an axial length less than the axial length of said matrix and with said rim in contact with said material;

inserting bar-like spokes in said slots with their faces at the pitch angles of said slots, said spokes having radially inner portions at said inner hub and their radially outer ends at said rim; and securing said spokes to said inner hub and to said rim.

12. A method as set forth in claim 11 further comprising mounting a central hub within and concentrically with said inner hub after cutting said slots in said matrix, said central hub having an external diameter smaller than the diameter of the internal base of said inner hub and securing said spokes to said central hub.

13. A method as set forth in claim 12 wherein said inner hub has an axial length at least equal to one-quarter of, but no greater than one-half of, the axial length of said matrix, wherein said rim has an axial length at least equal to one-half the axial length of said matrix and wherein said spokes extend over an axial end face of said rim and further comprising securing said spokes to said end face of said rim.

14. A method as set forth in claim 13 wherein the number of said slots divided by two is an odd whole number and pairs of said slots are cut along a diameter line extending from one peripheral face to the other peripheral face of said matrix.

15. A method as set forth in claim 11 wherein said inner hub, said wrapping hub are disposed with an axial end of each in a common plane, said strip of matrix material is wrapped around said inner and wrapping hubs with a side edge thereof in said plane and said rim is disposed with an axial end thereof in said plane.

16. A method as set forth in claim 11 wherein said spokes are secured to said rim by welding a gusset to each of them and to said rim.

17. A method as set forth in claim 11 or 16 wherein said spokes are secured to said inner hub by welding a gusset to each of them and to said inner hub.

18. A method as set forth in claim 11 wherein said pitch angle is not greater than ten degrees.

* * * * *